US009237799B1

(12) United States Patent
Manning, Jr.

(10) Patent No.: US 9,237,799 B1
(45) Date of Patent: Jan. 19, 2016

(54) ADJUSTABLE PAINT BRUSH POLE

(71) Applicant: Charlie L. Manning, Jr., Durham, NC (US)

(72) Inventor: Charlie L. Manning, Jr., Durham, NC (US)

( * ) Notice: Subject to any disclaimer, the term of this patent is extended or adjusted under 35 U.S.C. 154(b) by 389 days.

(21) Appl. No.: 13/975,705

(22) Filed: Aug. 26, 2013

(51) Int. Cl.
*A46B 17/02* (2006.01)
*A46B 7/02* (2006.01)
*A46B 5/00* (2006.01)

(52) U.S. Cl.
CPC . *A46B 17/02* (2013.01); *A46B 5/00* (2013.01); *A46B 7/02* (2013.01)

(58) Field of Classification Search
CPC ..... A46B 5/00; A46B 7/02; B25G 3/00
USPC ..... 15/143.1, 144.3, 144.1, 144.4, 146, 172
See application file for complete search history.

(56) References Cited

U.S. PATENT DOCUMENTS

| | | | | |
|---|---|---|---|---|
| 7,472,447 | B2 | 1/2009 | Lougheed | |
| 7,587,781 | B2 | 9/2009 | Vales | |
| 7,770,252 | B2 * | 8/2010 | Errichiello ..... | A46B 5/0075 15/144.1 |
| 8,065,774 | B2 | 11/2011 | Schiesz et al. | |
| 2005/0204497 | A1 | 9/2005 | Hillenbrand | |
| 2007/0157406 | A1 | 7/2007 | Kim | |
| 2011/0308027 | A1 | 12/2011 | Major | |

* cited by examiner

*Primary Examiner* — Monica Carter
*Assistant Examiner* — Stephanie Berry
(74) *Attorney, Agent, or Firm* — Robert C. Montgomery; Montgomery Patent & Design LP

(57) ABSTRACT

An adjustable paint brush pole has a brushing head attached to a handle. Disposed on the handle is a pivoting joint, allowing the brushing head to be angularly positioned relative to a base portion of the handle. Additionally, the base portion of the handle is internally threaded for receiving a threaded portion of an extension pole.

21 Claims, 7 Drawing Sheets

ADJUSTABLE PAINT BRUSH POLE

RELATED APPLICATIONS

There are no current related applications.

FIELD OF THE INVENTION

The presently disclosed subject matter is directed to paint brush holders. More particularly it relates to adjustable paint brush poles having locking pivoting heads for holding paint brushes at an adjustable angle.

BACKGROUND OF THE INVENTION

A common task when constructing or maintaining a building is painting. Proper painting is a time consuming activity that requires a set of workman skills, proper paints for the particular job, and the correct tools. While painting can be difficult, and while it may require painstaking patience, a job that is done well is readily apparent and personally rewarding.

Painting may require brushes, rollers, sprayers, cleaning agents, thinning agents, poles, ladders, scaffolding, and safety equipment as well as paint. Stooping is often required for low areas and ladders for high ones. Proper preparation and materials are important, as is the ability to properly select and use the tools.

One (1) of the most common tools used in painting is the paint brush. Paint brushes can be wide, narrow, long, short, straight and tapered. They can be comprised of common materials or exotic materials, either natural and/or man-made. While the common paint brush has existed for generations they nonetheless have problems. One (1) problem occurs when painting at either extremely high or extremely low elevations. Such elevations require the use of a ladder, or the ability to get on one's hands and knees to paint.

Other types of painting tools, such as paint rollers, are almost always provided with an expandable extension pole for making painting easier. Curiously extension poles for paint brushes either do not exist or are rare. Some painters have been known to tape or tie a paint brush to a broom handle to obtain additional lengths. While such an approach works it is neither handy nor efficient.

Accordingly, there exists a need for a paint brush pole for holding paint brushes. Preferably such a paint brush pole would allow painting to be performed at elevated or low positions. In practice such a paint brush pole would allow its paint brush head to be adjusted to different angles. Ideally adjustments could be made without the use of tools and in such a way that the paint brush would lock into place. Beneficially the paint brush head could be removed from the paint brush pole and used with another pole having a threaded coupling.

SUMMARY OF THE INVENTION

The principles of the present invention provide for a paint brush pole having a paint brush head that holds paint brushes. The paint brush pole allows painting at elevated or low positions. The paint brush head and the paint brush can be adjusted to lock into different angles. Attachments and adjustments are made without the use of tools. The paint brush head can be removed from the paint brush pole and used with another pole having a threaded coupling.

A paint brush pole that is in accord with the present invention includes an elongated extension pole having a threaded pole member and a swivel assembly having an elongated swivel body with a contoured handle and a brush groove that is defined between two (2) legs having aligned leg apertures. The swivel assembly further includes a spring well in the swivel body, a swivel spring in the spring well, and an indexing ball on the swivel spring. A paint brush with a brush handle having a handle aperture and a rounded bottom side edge with detents is also included. A fastener passes through the leg apertures and the handle aperture and attaches the paint brush to the swivel assembly such that the indexing ball compresses the swivel spring, which in turn biases the indexing ball toward the detents. The paint brush pole also includes a release assembly having a release body with a cavity for mating to the threaded pole member, a pivot having a pivot aperture, and an end with a first surface that defines a release cavity that is complementary with a first part of the contoured handle, and a clamp assembly having a clamp handle with at least one (1) clamp handle aperture and a clamp body with a clamp face that defines a clamp cavity that is complementary with a second part of the contoured handle. A pivot pin passes through the pivot aperture and clamp handle aperture for pivotally attaching the clamp assembly to the release assembly. The release cavity and the clamp cavity mate with the contoured handle to hold the swivel assembly and the indexing ball fits into a detent to lock the paint brush to the swivel assembly.

The brush handle is configured with a flat top and a flat bottom such that the brush handle can be attached to the swivel assembly by a threaded fastener and a nut. Also included may be a clamp spring that biases the clamp cavity toward the release cavity. The clamp spring can have spiral coils with diameters that increase from either end toward the center. The release body includes a spring mount for receiving the clamp spring and the clamp handle includes a spring tab for receiving the clamp spring.

Beneficially the contoured handle is contoured with a key and multiple ridges and grooves such that the release face and the clamp face form a face gap for receiving the key. The clamp cavity then includes ridges and grooves complementary to the contour of the contoured handle to form a first half of a holder for the contoured handle. The release cavity can then include ridges and grooves complementary to the contour of the contoured handle and thus form a second half of a holder for the contoured handle. The clamp cavity ridges and grooves match the release cavity ridges and grooves.

Preferably, the first surface extends parallel along the axis of the release body and the release body further includes a second surface that extends from the first face at an obtuse angle. The release body may include an internally threaded cavity that mates with the threaded pole member. The extension pole may then further include a stationary tube, an extending tube that telescopes from the stationary tube, and a collet ring for locking the extending tube to the stationary tube. Preferably the threaded pole member is an externally threaded member on an external end of the extending tube. Beneficially, the threaded pole member has an acme thread, the clamp body is an elongated semicircular member, and/or the clamp handle has a "U"-shaped cross-section.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
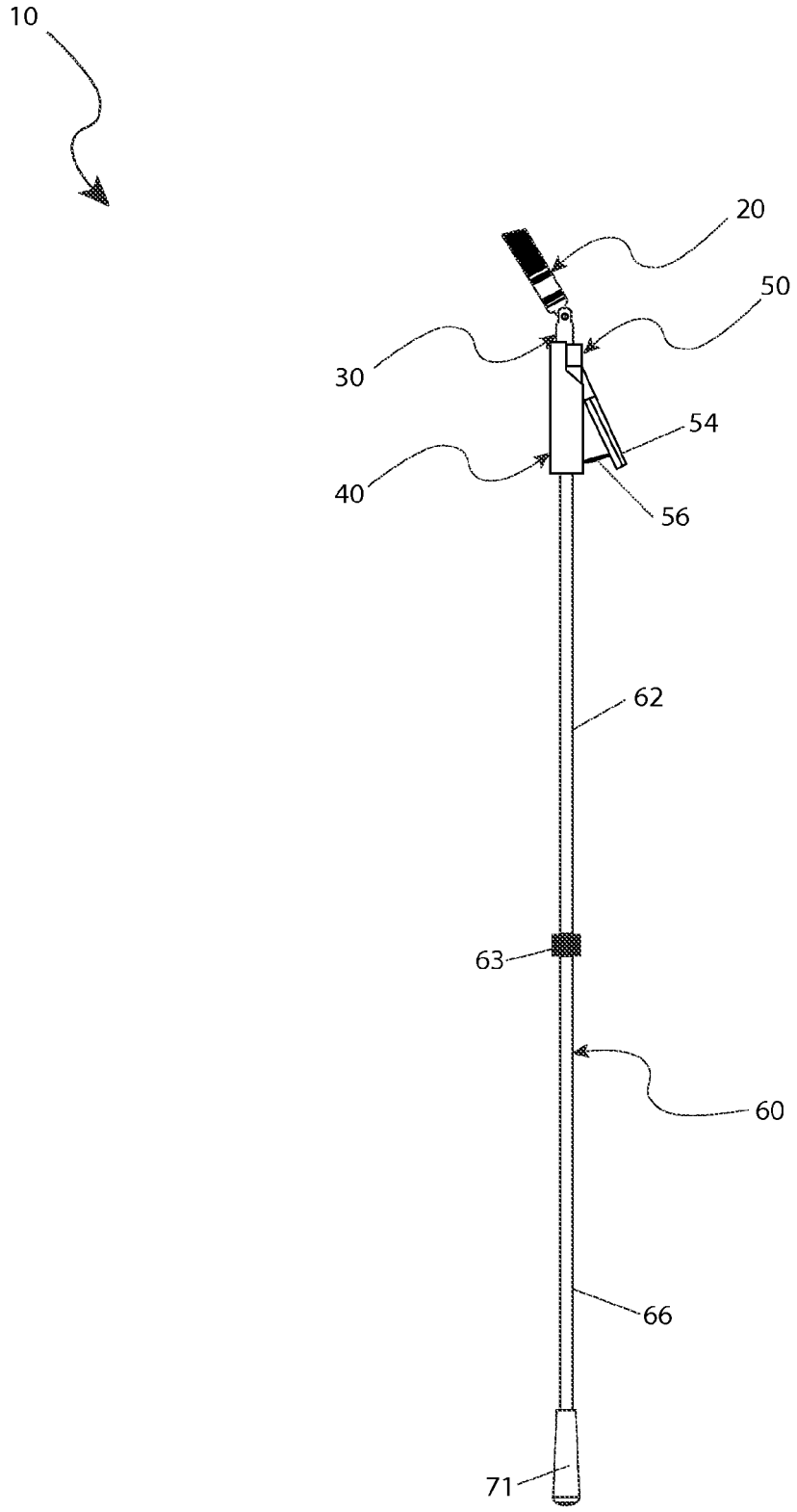
FIG. 1 illustrates an adjustable paint brush pole 10 that is in accord with a preferred embodiment of the present invention.

10 adjustable paint brush pole
20 paint brush
21 head
22 bristles
23 band
24 brush handle
25 handle aperture
26 detent
27 threaded fastener
28 nut
29 leg
30 swivel assembly
31 swivel body
32 brush groove
33 swivel aperture
34 grip aperture
35 spring well
36 contoured handle
37 key
38 swivel spring
39 indexing ball
40 release assembly
41 release body
42 release cavity
43 release faces
43*a* release first face
43*b* release second face
44 pivot
45 pivot aperture
46 pivot pin
47 face gap
48 threaded cavity
49 spring mount
50 clamp assembly
51 clamp body
52 clamp face
53 clamp cavity
54 clamp handle
55 handle apertures
56 clamp spring
57 spring tab
60 extension pole
61 threaded member
62 extending tube
63 collet ring
64 internal collet taper
65 internal collet thread
66 stationary tube
67 longitudinal slot
68 external taper
69 external thread
71 padding

DETAILED DESCRIPTION OF THE PREFERRED EMBODIMENT

The best mode for carrying out the invention is presented in terms of its preferred embodiment, herein depicted within FIGS. 1 through 12. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an adjustable paint brush pole 10 used for the application of paint or similar products that can be applied by a paint brush to a surface. The adjustable paint brush pole 10 enables the application of such products without using a ladder.

Figure 2:
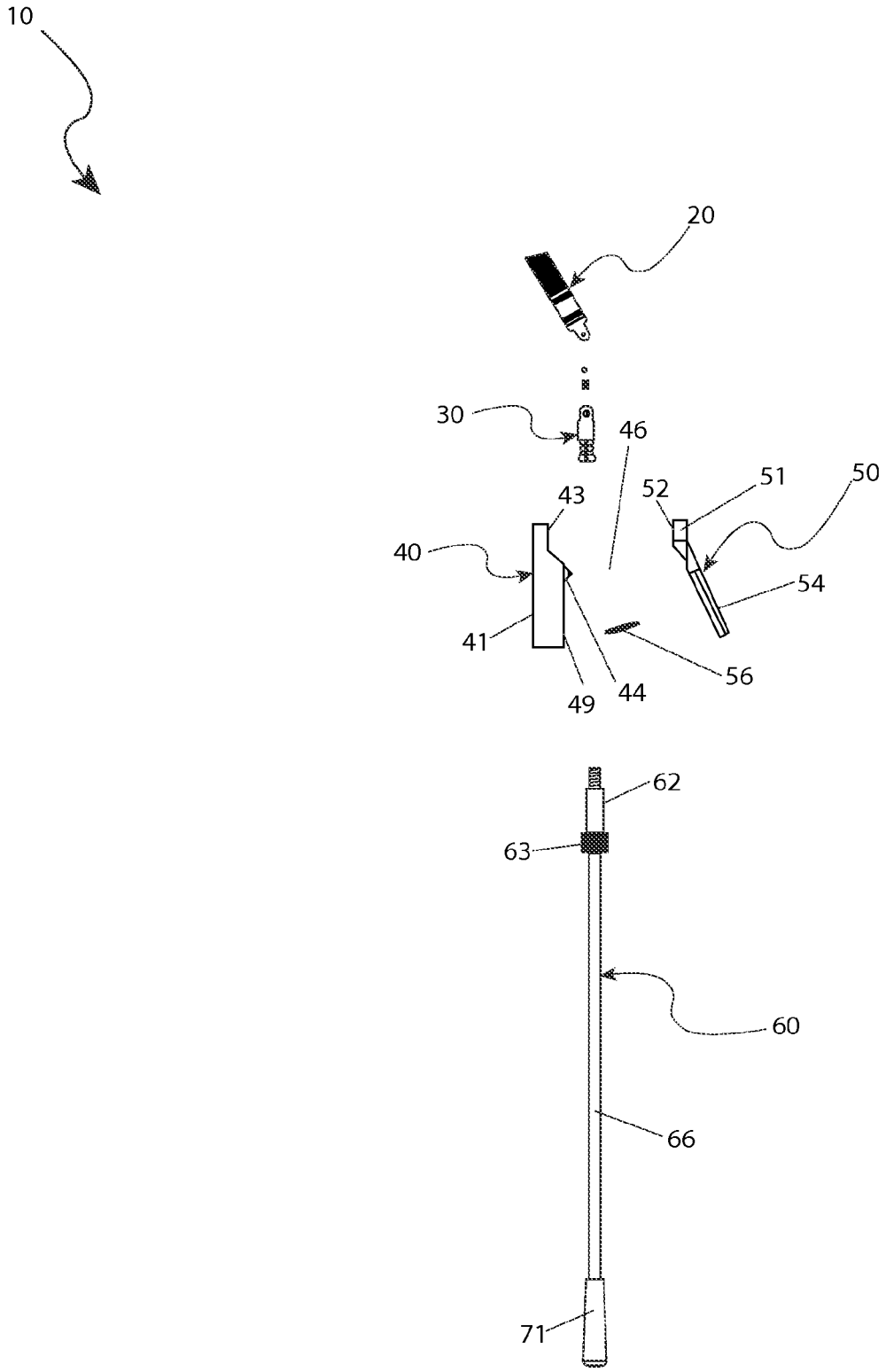
FIG. 2 is an exploded view of the adjustable paint brush pole 10 shown in FIG. 1.
Figure 4:
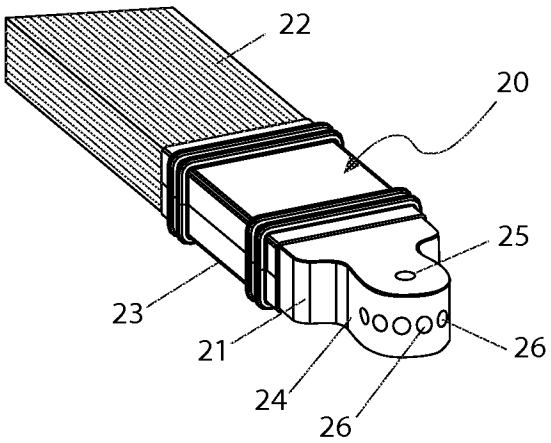
FIG. 4 is an isometric view of the paint brush 20 shown in FIG. 3.
Figure 3:
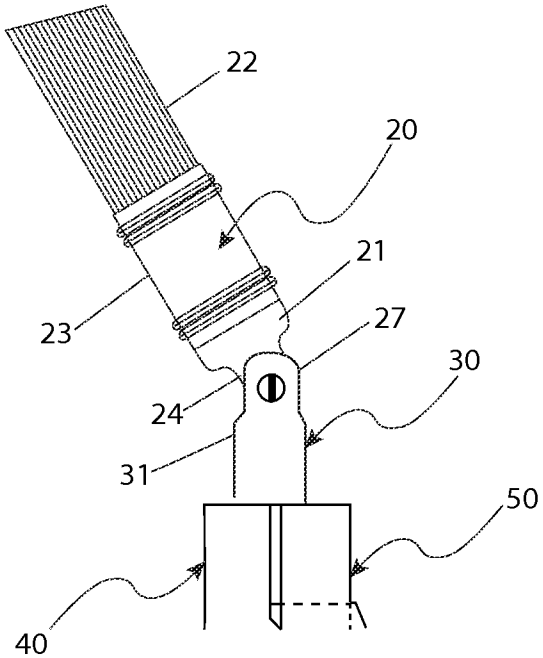
FIG. 3 is a detailed view of a paint brush 20 used in the adjustable paint brush pole 10 shown in FIG. 1.

FIG. 1 illustrates an assembled paint brush pole 10 while FIG. 2 presents an exploded view of that assembled paint brush pole 10. As shown, the paint brush pole 10 includes a paint brush 20, a swivel assembly 30, a release assembly 40, a clamp assembly 50 and an extension pole 60. Turning now to FIGS. 3 and 4, the paint brush 20 includes a plurality of bristles 22 that are attached to a head 21 by an encircling band 23. The paint brush 20 also includes a brush handle 24. The head 21 and the brush handle 24 are preferably formed as one (1) piece using an injection molding process. The head 21 and the brush handle 24 alternately can be formed from a blank piece of hard wood or other sufficiently strong, rigid material.

Referring primarily to FIGS. 3 and 4, the bristles 22 are preferably comprised of bristles made from the natural hair of any variety of animals, nylon, or other synthetic material and are trimmed to form a tapered edge. The ends of one (1) or more bristles 22 may be split or frayed to produce a desired coating texture. The encircling band 23 is preferably brass or another relatively non-reactive metal. In any event the band 23 is formed into a shape that retains the bristles 22 in the head 21 either by using an interference fit or by retaining the bristles 22 using an epoxy-filled bed located between the head 21 and the band 23.

The brush handle 24 has a circular handle aperture 25 that is used to secure the paint brush 20 to the swivel assembly 30 using a threaded fastener 27 and a nut 28. The end of the brush handle 24 is configured with a flat top and a flat bottom and a rounded side edge having detents 26. Preferably, the depth and diameter of the detents 26 are sufficient to accommodate between forty five percent (45%) to forty eight percent (48%) of the volume of an indexing ball 39, see FIG. 5.

Figure 6:
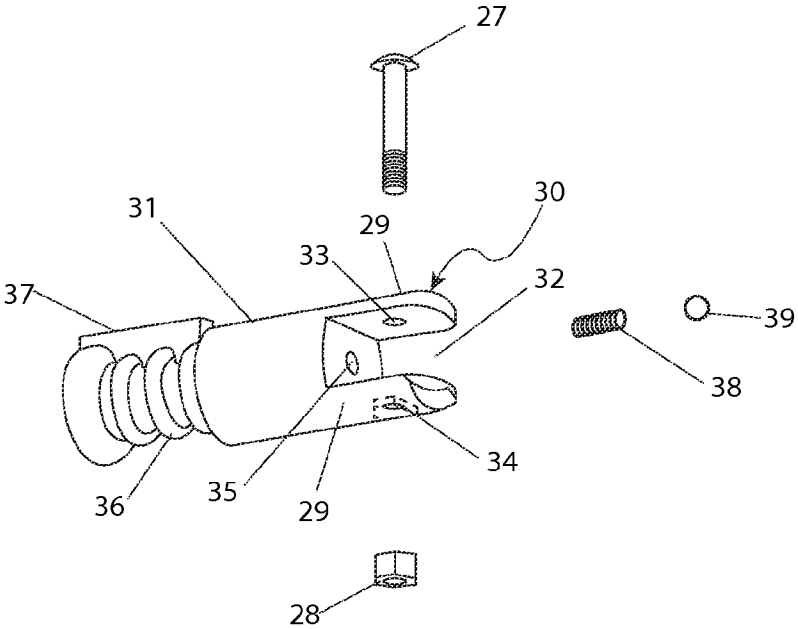
FIG. 6 is another exploded isometric view of the swivel assembly 30 shown in FIG. 5.
Figure 5:
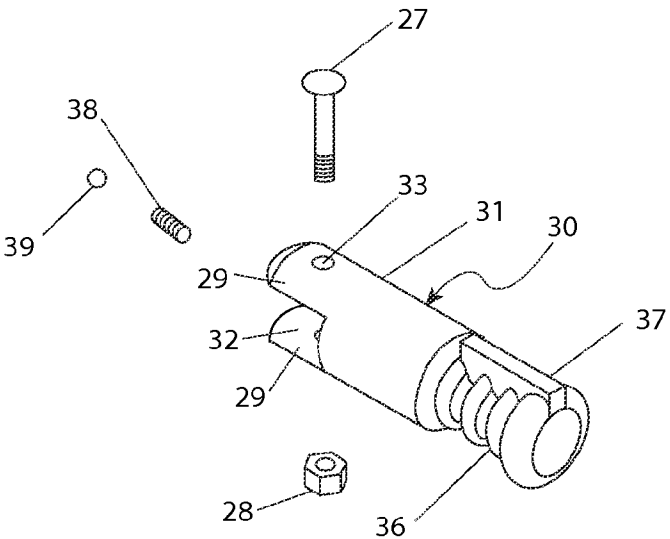
FIG. 5 is an exploded isometric view of a swivel assembly 30 used in the adjustable paint brush pole 10 shown in FIG. 1.

FIGS. 5 and 6 present isometric views of the swivel assembly 30 used in the paint brush pole 10. As shown, the swivel assembly 30 includes a swivel body 31. The swivel body 31 is a cylinder having a multiple ring contoured handle 36 at one end and a brush groove 32 at the other. The brush groove 32 defines legs 29. A swivel aperture 33 and an aligned grip aperture 34 extend through the legs 29. A spring well 35 is formed into the swivel assembly 30 at the base of the brush groove 32. The spring well 35 and its use are described in more detail subsequently. Beneficially the swivel assembly 30 is made of a thermoplastic material formed by an injection molding process.

The swivel assembly 30 is used to retain the paint brush 20 during use. The paint brush 20 is held in the brush groove 32 by the insertion of a threaded fastener 27 through the swivel aperture 33, through the paint brush 20 handle aperture 25, and through the grip aperture 34. Once inserted the threaded fastener 27 is tightened by a nut 28. The grip aperture 34 preferably includes a hexagonal depression that receives and holds the nut 28 while the threaded fastener 27 is tightened.

The spring well 35 is a circular cavity formed in the swivel body 31 at the center of the brush groove 32. The depth and diameter of the spring well 35 are such that the spring well 35 receives a swivel spring 38 and an indexing ball 39 in a loose fit. When the brush handle 24 is pivotally secured in the brush groove 32 the indexing ball 39 is captured between the brush handle 24 and the swivel spring 38. The swivel spring 38 biases the indexing ball 39 towards the detents 26 in the brush handle 24. When one (1) of the detents aligns with the indexing ball 39 the indexing ball 39 moves into the detent, locking the paint brush 20 in place. However, if a sufficiently strong force is applied to the paint brush 20 in the proper direction the paint brush 20 will pivot about the threaded fastener 27, ejecting the indexing ball 39 from the detent 26. This unlocks the paint brush 20, compresses the swivel spring 38, and allows relatively free rotation of the paint brush 20 until the next detent 26 aligns with the indexing ball 39.

Referring now to FIGS. 5, 6, 8, and 9*a*, the contoured handle 36 of the swivel assembly 30 is formed with a plurality of ridges and grooves that match complementary ridges and grooves in a release cavity 42 of a release assembly 40 and in a clamp cavity 53 of a clamp assembly 50. The contoured handle 36 also has at least one (1) key 37. The key 37 prevents the free rotation of the swivel assembly 30 about its central axis when it is retained in the release assembly 40 and in the clamp assembly 50.

Figure 9A:
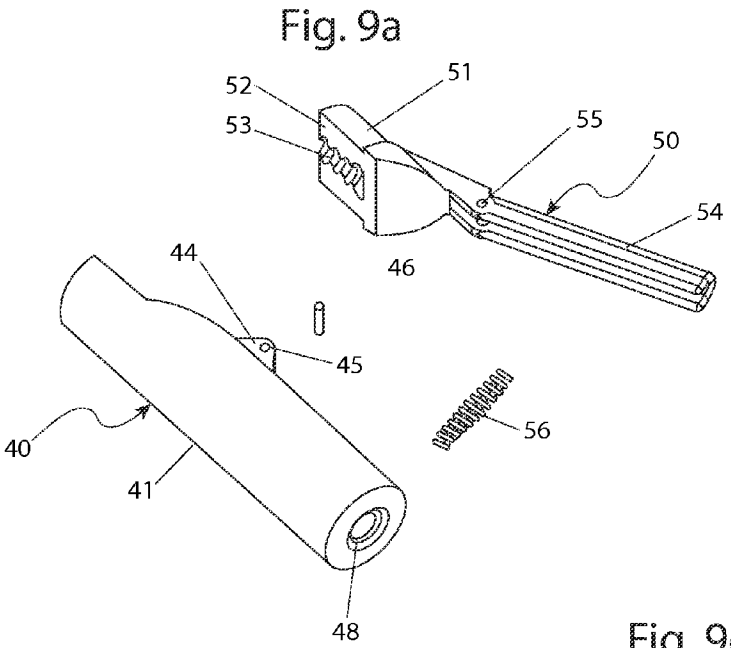
FIG. 9*a* is an isometric exploded view of a release assembly 40 and a clamp assembly 50 shown in FIGS. 7*a* and 7*b;*
Figure 9C:
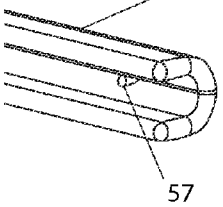
FIG. 9*c* is a close-up view of a spring tab 57 in a clamp handle 54 as used in the adjustable paint brush pole 10 shown in FIG. 1.
Figure 9B:
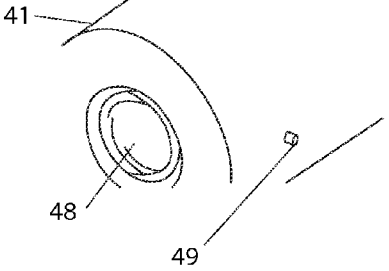
FIG. 9*b* is a close-up view of a spring mount 49 on a release body 41 as used in the adjustable paint brush pole 10 shown in FIG. 1.
Figure 8:
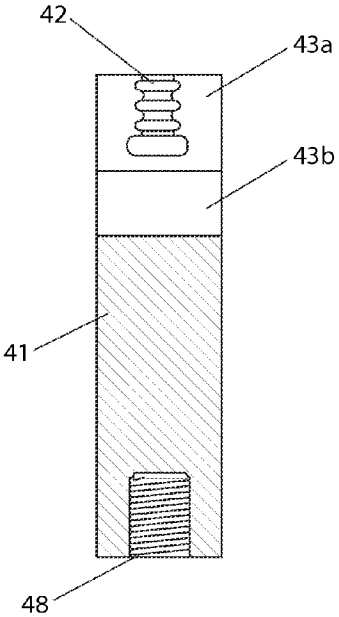
FIG. 8 represents a cross-sectional view taken along line A-A of FIG. 7*a;*

FIGS. 8, 9*a*, and 9*b* show the release assembly 40 in more detail. The release assembly 40 has a generally cylindrically shaped release body 41 which is preferably made from a thermoplastic material using an injection-molding process. The release body 41 is configured with an internally threaded cavity 48 at one end and a medially located pivot 44 having a pivot aperture 45. The threaded cavity 48 would preferably have a standard acme thread that accommodates mating with an externally threaded member 61 on the extension pole 60 (see FIG. 10).

Figure 7B:
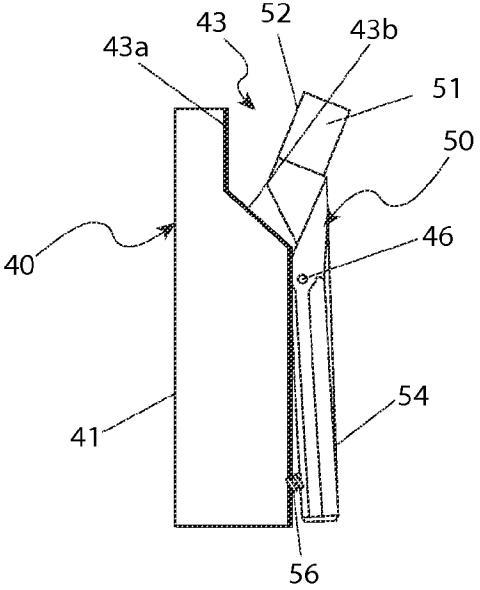
FIG. 7*b* illustrates an open release assembly 40 and a clamp assembly 50 used in the adjustable paint brush pole 10 shown in FIG. 1.

Turning now to FIG. 7*b*, one (1) end of the release body 41 is specially formed to define a release first face 43*a* that extends parallel along the axis of the release body 41 and a release second face 43*b* that extends from the release first face 43*a* at an obtuse angle.

As best shown in FIG. 8, the release cavity 42 is formed into the release first face 43*a*. The release cavity 42 is comprised of a plurality of ridges and grooves that are complementary with the ridges and grooves of the contoured handle 36 of the swivel assembly 30 shown in FIGS. 5 and 6. The release cavity 42 forms half of a holder for the contoured handle 36.

FIG. 9*a* illustrates the clamp assembly 50 of the paint brush pole 10. The clamp assembly 50 includes a clamp body 51 and a clamp handle 54, which are preferably made of a thermoplastic material and formed in an injection molding process. The clamp body 51 is generally an elongated semicircular member having a clamp face 52 into which a clamp cavity 53 is formed. The clamp cavity 53 is comprised of a plurality of ridges and grooves that are complementary to the shape of the contoured handle 36 of the swivel assembly 30 shown in FIGS. 5 and 6. The clamp cavity 53 forms the second half of a holder for the contoured handle 36.

As best shown in FIG. 9*c*, the clamp handle 54 has a "U"-shaped cross-section. This enables the clamp handle 54 to straddle the pivot 44 of the release assembly 40 (see FIG. 9*a*). Disposed through the clamp handle 54 are two (2) aligned handle apertures 55 which are located and configured to align with the pivot aperture 45 in the pivot 44. The pivot aperture 45 is placed between and aligned with the handle apertures 55. Then a pivot pin 46 with a retainer is inserted through the aligned apertures to pivotally attach the clamp assembly 50 to the release assembly 40.

A spring steel clamp spring 56 with a coil spiral diameter which increases from either end toward the center is mounted between the release body 41 and the clamp handle 54. Referring now to FIGS. 7*a*, 7*b*, 9*b*, and 9*c* the clamp spring 56 is disposed between the spring mount 49 of the release body 41 (FIG. 9*b*) located near the bottom of the release body 41 and the spring tab 57 of the clamp handle 54 (FIG. 9*c*). The increasing diameter of the clamp spring 56 toward its center allows the centerline of the smaller diameter clamp spring 56 ends to be compressed along the centerline of the clamp spring 56. This configuration permits more spring compression than a straight coil spring.

Figure 7A:
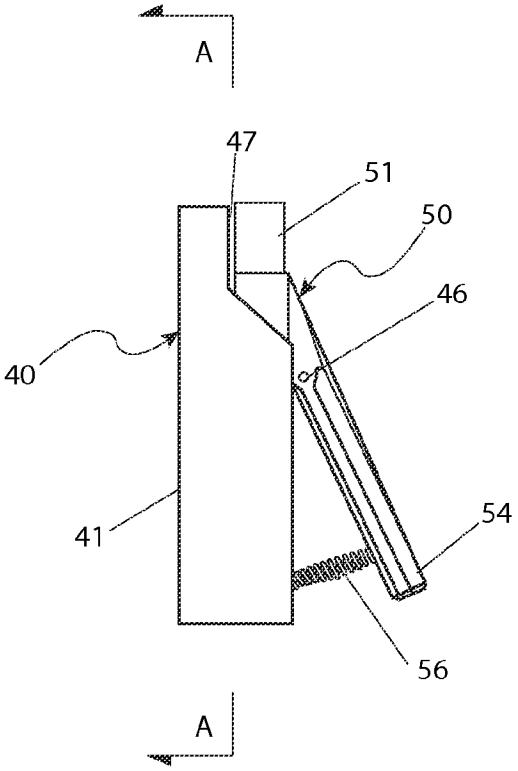
FIG. 7*a* illustrates a closed release assembly 40 and a clamp assembly 50 used in the adjustable paint brush pole 10 shown in FIG. 1.

As shown in FIGS. 7*a* and 7*b*, the clamp spring 56 biases the release body 41 and the clamp handle 54 apart. This causes the release first face 43*a* and the clamp face 52 to be biased toward one (1) another as the clamp handle 54 pivots on the pivot 44. The release body 41 and the clamp handle 54 are configured such that a face gap 47 exists between the release first face 43*a* and the clamp face 52.

In use, the contoured handle 36 of the swivel assembly 30 (FIGS. 5 and 6) is placed into a holder formed by the release cavity 42 (FIG. 8) and the clamp cavity 53 (FIG. 9*a*) such that the key 37 is located in the face gap 47 (FIG. 7*a*). The swivel body 31 then move as one (1) unit with the release assembly 40. When a user grasps the release body 41 and the clamp handle 54 and forces the clamp handle 54 toward the release body 41 the clamp spring 56 is compressed, the clamp body 51 pivots away from the release first face 43*a* (shown in FIG. 7*b*) and the swivel assembly 30 and its attached paint brush 20 is released.

It is understood that the paint brush pole 10 may be configured without using the release mechanism comprised of the combination of the swivel assembly 30 and the clamp assembly 50. This is accomplished by inserting a threaded member, such as the threaded member 61 of the extension pole (see below) into the threaded cavity 48 of the release body 41.

Figure 11:
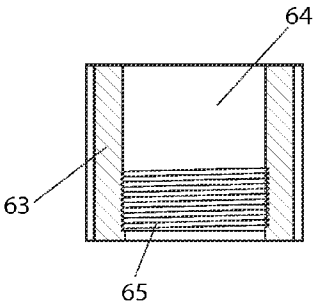
FIG. 11 represents a cross-sectional view taken along line B-B of FIG. 10; and, FIG. 12 is a perspective view of a first end of a stationary tube 66 as used in the adjustable paint brush pole 10 shown in FIG. 1.
Figure 10:
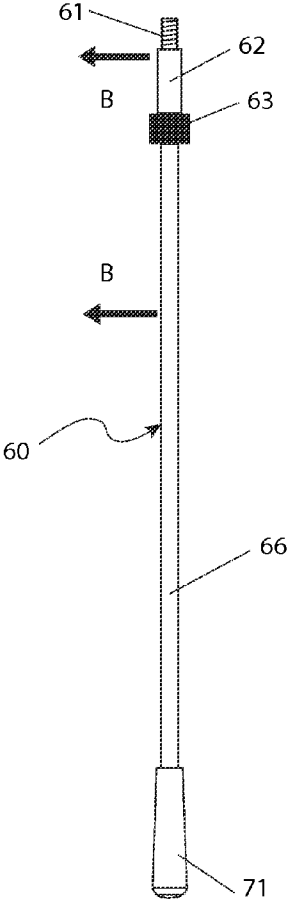
FIG. 10 illustrates the extension pole 60 used in the adjustable paint brush pole 10 shown in FIG. 1.

Referring now to FIGS. 10 and 11, the extension pole 60 has an extending tube 62 that telescopes from a stationary tube 66 and which is held in place by a collet ring 63. The extending tube 62 and the stationary tube 66 are preferably round steel tubing configured to telescope together. The extending tube 62 and the stationary tube 66 are beneficially plated or coated with a protective material to inhibit corrosion. A first end of the extending tube 62 has the externally threaded member 61. The threaded member 61 is preferably a thermoplastic material formed using an injection molding process. The threaded member 61 is preferably a standard acme thread that mates with the threaded cavity 48 in the release body 41. It is understood that alternate materials of construction, and/or modes of attachment could be employed without limiting the scope of this invention.

Figure 12:
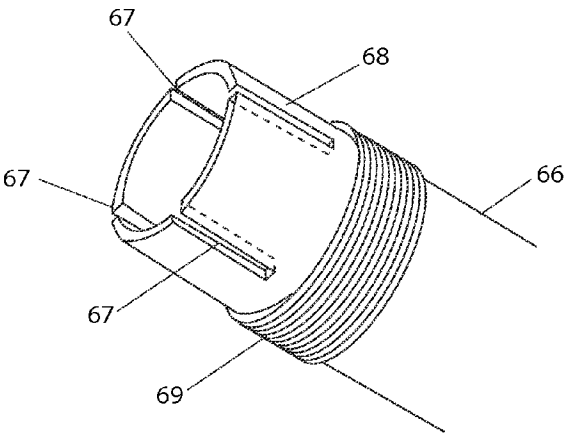

One (1) end of the stationary tube 66 has a taper 68 in front of an external thread 69. The external thread 69 preferably has a unified fine thread profile formed on the outside of the stationary tube 66. The external taper 68 is formed by the removal of tube wall material from the external thread 69 to the first end. The external taper 68 is applied to four (4) longitudinal slot 67 slots in the stationary tube 66 as shown in FIG. 12. The other end of the stationary tube 66 is fitted with foam padding 71 that forms a handle.

Referring now to FIG. 11, the collet ring 63 is a thermoplastic annular ring having an internal collet taper 64 and an internal collet thread 65. The internal collet taper 64 complements the external taper 68 of the stationary tube 66. The internal collet thread 65 mates with the external thread 69 on the stationary tube 66.

The proximal end (not shown for simplicity) of the extending tube 62 is inserted through the collet ring 63 (including the internal collet taper 64 and collet thread 65) and into the distal end of the stationary tube 66 to produce the desired length of the extension pole 60. The internal collet thread 65 is then engaged with the external thread 69 and turned. Ideally when more than three (3) turns are applied the internal collet taper 64 contacts the external taper 68 on the stationary tube 66. Further turning deforms the distal end of the stationary tube 66 causing narrowing of the longitudinal slot 67 to lock the extending tube 62 and stationary tube 66 together.

The paint brush pole 10 may be configured without the extending tube 62 and the collet ring 63. This is accomplished by threading the threaded member 61 directly into the threaded cavity 48 of the release body 41.

The preferred embodiment of the present invention can be utilized by a user with little or no training. The method of installing and utilizing the paint brush pole 10 may be achieved by: acquiring a model of the paint brush pole 10 having the desired features consistent with the width of the paint brush 20; assembling the paint brush pole 10 as indicated in FIG. 1; executing the preparatory steps to perform the desired procedure; applying the brush-on material to the paint brush 20; manipulating the paint brush pole 10 to apply the material to a surface; and cleaning the paint brush pole 10 when done. During the execution of the procedure the paint brush 20 and the swivel assembly 30 may be detached from the extension pole 60 by grasping the release body 41 and the clamp handle 54 and forcing the clamp handle 54 toward the release body 41, thus overriding and compressing the clamp spring 56, whereupon the clamp body 51 is pivoted away from the release faces 43 as seen in FIG. 7*b* and the swivel assembly 30 with the attached paint brush 20 is released.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A paint brush pole, comprising:

an elongated extension pole having a threaded pole member;

a swivel assembly having an elongated swivel body with a contoured handle and a brush groove defined between two legs with aligned leg apertures, said swivel assembly further including a spring well in said swivel body, a swivel spring in said spring well, and an indexing ball on said swivel spring;

a paint brush having a brush handle with a handle aperture and a rounded bottom side edge with detents;

a fastener passing through said leg apertures and said handle aperture and attaching said paint brush to said swivel assembly such that said indexing ball compresses said swivel spring which biases said indexing ball toward said detents;

a release assembly having a release body with a cavity for mating to said threaded pole member, a pivot having a pivot aperture, and an end with a first surface that defines a release cavity complementary with a first part of said contoured handle;

a clamp assembly having a clamp handle having at least one clamp handle aperture and a clamp body with a clamp face that defines a clamp cavity complementary with a second part of said contoured handle;

a pivot pin passing through said pivot aperture and said at least one clamp handle aperture and pivotally attaching said clamp assembly to said release assembly;

wherein said release cavity and said clamp cavity mate with said contoured handle to hold said swivel assembly; and, wherein said indexing ball fits into a detent to lock said paint brush to said swivel assembly.

2. The paint brush pole according to claim 1, wherein said brush handle is configured with a flat top and a flat bottom.

3. The paint brush pole according to claim 1, wherein said brush handle is attached to said swivel assembly by a threaded fastener and a nut.

4. The paint brush pole according to claim 1, further including a clamp spring biasing said clamp cavity toward said release cavity.

5. The paint brush pole according to claim 4, wherein said clamp spring has spiral coils with diameters which increases from either end toward the center.

6. The paint brush pole according to claim 4, wherein said release body includes a spring mount for receiving said clamp spring and said clamp handle includes a spring tab for receiving said clamp spring.

7. The paint brush pole according to claim 1, wherein said contoured handle is contoured with a key and multiple ridges and grooves.

8. The paint brush pole according to claim 7, wherein said release face and said clamp face form a face gap for receiving said key.

9. The paint brush pole according to claim 7, wherein said clamp cavity includes ridges and grooves complementary to said contour of said contoured handle.

10. The paint brush pole according to claim 9, wherein said clamp cavity forms a first half of a holder for said contoured handle.

11. The paint brush pole according to claim 9, wherein said release cavity includes ridges and grooves complementary to said contour of said contoured handle.

12. The paint brush pole according to claim 11, wherein said release cavity forms a second half of a holder for said contoured handle.

13. The paint brush pole according to claim 12, wherein said clamp cavity ridges and grooves match said release cavity ridges and grooves.

14. The paint brush pole according to claim 1, wherein said first surface extends parallel along the axis of said release body.

15. The paint brush pole according to claim 14, wherein said release body further includes a second surface that extends from said first face at an obtuse angle.

16. The paint brush pole according to claim 1, wherein said release body includes an internally threaded cavity that mates with said threaded pole member.

17. The paint brush pole according to claim 1, wherein said extension pole further includes a stationary tube, an extending tube that telescopes from said stationary tube, and a collet ring for locking said extending tube to said stationary tube.

18. The paint brush pole according to claim 17, wherein said threaded pole member is an externally threaded member on an external end of said extending tube.

19. The paint brush pole according to claim 18, wherein said threaded pole member has an acme thread.

20. The paint brush pole according to claim 1, wherein said clamp body is an elongated semicircular member.

21. The paint brush pole according to claim 20, wherein said clamp handle has a "U"-shaped cross-section.

* * * * *